US006304255B1

(12) United States Patent
Suzuki et al.

(10) Patent No.: US 6,304,255 B1
(45) **Date of Patent: *Oct. 16, 2001**

(54) REFERENCE POTENTIAL GENERATING CIRCUIT FOR LIQUID CRYSTAL DISPLAY APPARATUS

(75) Inventors: Toshiaki Suzuki; Toshimitsu Minemura, both of Kawasaki; Masanori Nishido, Inagi; Seiji Hayashimoto; Mikio Oshiro, both of Kawasaki, all of (JP)

(73) Assignee: Fujitsu Limited, Kawasaki (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/175,075

(22) Filed: Oct. 19, 1998

(30) Foreign Application Priority Data

Dec. 1, 1997 (JP) ..... 9-347222

(51) Int. Cl.[7] ..... G09G 5/00

(52) U.S. Cl. ..... 345/211; 345/87; 345/95; 345/210; 345/212; 345/213; 345/214; 345/215

(58) Field of Search ..... 345/211, 212, 345/213, 214, 215, 87, 95, 210

(56) References Cited

U.S. PATENT DOCUMENTS

| | | | | |
|---|---|---|---|---|
| 5,532,718 | * | 7/1996 | Ishimaru | 345/211 |
| 5,745,092 | * | 4/1998 | Ito | 345/95 |
| 5,751,278 | * | 5/1998 | Inamori et al. | 345/211 |
| 5,841,412 | * | 11/1998 | Ebihara | 345/58 |

FOREIGN PATENT DOCUMENTS

| | | |
|---|---|---|
| 553534 | 3/1993 | (JP) . |
| 6089073 | 3/1994 | (JP) . |
| 8021984 | 1/1996 | (JP) . |
| 8129365 | 5/1996 | (JP) . |

* cited by examiner

*Primary Examiner*—Richard Hjerpe
*Assistant Examiner*—Jean Lesperance
(74) *Attorney, Agent, or Firm*—Greer, Burns & Crain, Ltd.

(57) ABSTRACT

A reference potential generating circuit for liquid crystal display apparatus includes an outside reference potential generating circuit for generating a pair of outside reference potentials, and an inside reference potential generating circuit for generating a pair of inside reference potentials, which are between the outside reference potentials and are independent of the outside reference potentials. The outside or the inside reference potential generating circuit has a variable resister for correcting a deviation of a center potential of the outside or inside reference potentials.

21 Claims, 10 Drawing Sheets

REFERENCE POTENTIAL GENERATING CIRCUIT FOR LIQUID CRYSTAL DISPLAY APPARATUS

BACKGROUND OF THE INVENTION

1. Field of the Invention

The present invention relates to a reference potential generating circuit for use in a liquid crystal display apparatus.

2. Description of the Related Art

FIG. 8 is a schematic diagram showing a prior art liquid crystal display apparatus.

In LCD panel 2, a matrix of liquid crystal pixels including pixel 2*a* are formed. LCD panel 2 holds a liquid crystal layer between a TFT substrate and an opposite substrate. On the TFT substrate, data lines, scanning lines perpendicular to data lines, a matrix of TFT (thin-film transistor) and a matrix of display electrodes are formed. On the opposite substrate, common opposite electrode is formed.

Common potential VC is applied from common voltage dividing circuit 3 to the opposite electrode of liquid crystal pixel 2*a*, and display electrode of liquid crystal pixel 2*a* is connected through TFT 2*b* to data line DLj. A gate of TFT 2*b* is connected to scanning line SLi. A scanning pulse of, for example, a high being 20V and a low being −5V are applied from scanning driver 4 to the scanning lines SLi. With this pulse, TFT 2*b* is turned on to cause a signal potential from data driver 5 to be applied through data line DLj and TFT 2*b* onto the display electrode of liquid crystal pixel 2*a*. The signal potential is one of reference potentials V0 through V9 provided from reference potential generating circuit 6 to data driver 5 or one of further divided potentials of reference potentials V0 through V9, and the same is determined in compliance with display data DAT. Scanning driver 4 and data driver 5 are controlled by control signals from control circuit 7, and the control signals are generated based on horizontal synchronization signals *HS and vertical synchronization signals *VS.

The display electrode potential of liquid crystal pixels 2*a* is lowered by ΔVgsd according to the parasitic capacity between the gate and source of TFT 2*b* and between the source and the rain thereof when the scanning pulse falls down to a low to turn off TFT 2*b*.

It is assumed that one of V0 through V9 is applied to data line DLj according to display data DAT. In a case where V0 through V9 are, for example, reference potential set V_SET1 (V10 through V19) shown in FIG. 10, the display electrode potential of liquid crystal pixel 2*a* becomes as in reference potential set V_SET2 (V20 through V29) by shifting down of ΔVgsd. Liquid crystal is driven by alternate current, so the polarity of application voltage is reversed with respect to the common potential VC, for example, at every frame. In a case where the display data is constant, for example, voltages (V21−VC) and −(VC−V28) are alternately applied to liquid crystal pixels 2*a* at every frame. Since (V21−VC)<(VC−V28), the image flickers. Furthermore, the time average of accumulation charge of liquid crystal pixel 2*a* does not become zero, charge is accumulated in liquid crystal pixel 2*a* to cause an image to be residual.

Hence, if it is constructed that, taking ΔVgsd into consideration, the potentials of V0 through V9 are raised as reference potential set V_(V30 through V39) so as to secure reference potential set V_SET1(V10 through V19) after shifting down by ΔVgsd, the above-mentioned problem can be solved.

That is, the center potential of a pair of reference potentials (V0+V9)/2, (V1+V8)/2, (V2+V7)/2, (V3+V6)/2, and (V4+V5)/2, should be set to VC+ΔVgsd. ΔVgsd=ΔV−$\mu$(Vu−Vd)/2 holds, wherein Vd denotes V9, V8, V7, V6 or V5, while Vu denotes V0, V1, V2, V3 or V4, respectively, and wherein ΔV and $\mu$ are positive and determined by the capacity of liquid crystal pixel 2*a*, the parasitic capacity of TFT 2*b* and so on.

Therefore, the reference potential generating circuit may be constituted so that the following equation holds.

$$(Vu+Vd)/2=VC+\Delta V-\mu(Vu-Vd)/2 \quad (1)$$

FIG. 9 shows a prior art reference potential generating circuit.

In FIG. 9, R11 through R21 and R25 through R27 are fixed resistors for voltage dividing, R28 and R29 are fixed resistors for compensating ΔVgsd, and 11, 12, 21, 22, 31 through 33 and 46 through 48 are voltage follower circuits for voltage buffering with an amplification factor of 1.

V0 and V9 are determined by outside reference potential generating circuit 10A, V4 and V5 are mainly determined by inside reference potential generating circuit 20A, voltage between V0 and V4 is divided by voltage dividing circuit 30 to cause V1 through V3 to be picked up, and voltage between V5 and V9 is divided by voltage dividing circuit 40 to cause V6 through V8 to be picked up. The resistance values of resistors R11 and R21 are equal to each other, the resistance values of resistors R26 and R27 are equal to each other, and the resistance values of resistors R12 through R15 are equal to the resistance values of resistors R20 through R17, respectively.

In the case where resistors R28 and R29 are not connected, the upper potentials V0 to V4 and lower potentials V9 to V5 become symmetrical with respect to the common voltage VC as reference potential set V_of FIG. 10. By resistor R28, or resistors R28 and R29 as in FIG. 9 of a proper resistance value for compensating ΔVgsd, it is possible to meet equation (1).

On the other hand, since the liquid crystal transmittance of LCD panel 2 changes according to the visual angle of a viewer who looks thereat, it is necessary to make the reference potential adjustable by employing a variable resistor instead of fixed resister 25. Furthermore, it is necessary to employ a variable resistor instead of fixed resistor 25 in order to perform γ-correction.

However, in the case of construction of FIG. 9, although the above-mentioned equation (1) can hold with respect to a certain resistance value of resistor 25, the equation (1) is not satisfied if the resistance value is changed, thereby the above-mentioned flickering or residual image occurs.

SUMMARY OF THE INVENTION

In view of the above-mentioned problems, an object of the present invention is to provide a reference potential generation circuit in which a deviation of the center potential of a pair of reference potentials from a common potential of a liquid crystal pixel opposite electrode can be compensated even if a plurality of reference potentials are thoroughly adjusted.

In the 1st aspect of the present invention, there is provided a reference potential generating circuit for liquid crystal display apparatus, comprising: an outside reference potential generating circuit (10) for generating a pair of outside reference potentials (V0 and V9); an inside reference potential generating circuit (20) for generating a pair of inside reference potentials which are between the outside reference potentials (V4 and V5); and wherein the outside or inside reference potential is variable with correcting a deviation of a center potential ((V0+V9)/2 or (V4+V5)/2) of the outside or inside reference potentials.

With the 1st aspect of the present invention, a deviation of the center potential of a pair of reference potentials from the common potential of liquid crystal pixel opposite electrode can be compensated even if a plurality of reference potentials are thoroughly adjusted, a flickering or residual images can be prevented, and the display quality of a liquid crystal display apparatus can be improved.

In the 2nd aspect of the present invention, there is provided a reference potential generating circuit as defined in the 1st aspect, wherein the outside reference potential generating circuit (10) comprises: a combined resistor having first and second resistors connected in parallel, the first resistor having a variable resistor (RV) for adjustment; a third resistor (R11) connected between a first power source potential (VDD) and the combined resistor; a fourth resistor (R25 and R21) connected between the combined resistor and a second power source potential (GND); a first voltage buffer circuit (11) connected at a tap of the second resistor (R23 and R24), for providing one (V0) of the outside reference potentials; and a second voltage buffer circuit (12) connected at a tap of the fourth resistor (R23 and R24), for providing the other (V9) of the outside reference potentials.

In the 3rd aspect of the present invention, there is provided a reference potential generating circuit as defined in the 2nd aspect, wherein the inside reference potential generating circuit (20) comprises: a fifth through a seventh (R26, R16 and R27) resistors connected in series between the first and second power source potentials, a third voltage buffer circuit (21), connected at a node between the fifth resistor and the sixth resistor, for providing the one (V4) of the inside reference potentials, and a fourth voltage buffer circuit (22), connected at a node between the sixth resistor and the seventh resistor, for providing the other (V5) of the inside reference potentials.

With the 3rd aspect of the present invention, the inside reference potentials can be fixed, not depending on adjustment of the resistance value of the variable resistor (RV).

In the 4th aspect of the present invention, there is provided a reference potential generating circuit as defined in the 3rd aspect. The circuit further comprises: a first voltage dividing circuit (30) connected between an output of the first voltage buffer circuit (11) and an output of the third voltage buffer circuit (21); and a second voltage dividing circuit (40) connected between an output of the fourth voltage buffer circuit (22) and an output of the second voltage buffer circuit (12), the second voltage dividing circuit being approximately same as the first voltage dividing circuit.

In the 5th aspect of the present invention, there is provided a reference potential generating circuit as defined in the 4th aspect, wherein a resistance value of the fifth resistor (R26) is lower than that of the seventh resistor (R27).

With the 5th aspect of the present invention, since the resistance value of the corresponding fifth resistor (R26) is made smaller than the resistance value of the corresponding seventh resistor (R27) with respect to $\Delta V$ of the above-mentioned equation (1), the center potential between the inside reference potentials increases without adding a compensating resistor described later to cause the relation of equation (1) to be satisfied.

In the 6th aspect of the present invention, there is provided a reference potential generating circuit as defined in the 4th aspect, further comprises a first compensating resistor (R28) connected between the output of the first voltage buffer circuit (11) and an input of the third voltage buffer circuit (21).

With the 7th aspect of the present invention, the resistance value of the fifth resistor may be equal to that of the seventh resistor.

In the 7th aspect of the present invention, there is provided a reference potential generating circuit as defined in the 6th aspect. This ciurcuit further comprises a second compensating resistor (R29) connected between an input of the fourth voltage buffer circuit (22) and the output of the second voltage buffer circuit (12).

With the 7th aspect of the present invention, the freedom of design can be increased since the number of design parameters increases by the second compensating resistor (R29).

In the 8th aspect of the present invention, there is provided a reference potential generating circuit as defined in the 4th aspect, wherein each of the first and second voltage dividing circuit (30 and 40) comprises a plurality of voltage dividing resistors connected in series and a plurality of voltage buffer circuits each of which is connected at a node between corresponding adjacent two of the voltage dividing resistors to provide a divided potential.

In the 9th aspect of the present invention, there is provided a reference potential generating circuit as defined in the 3rd aspect. This circuit further comprises: a first voltage dividing circuit (30) connected between an output of the first voltage buffer circuit (11) and an input of the third voltage buffer circuit (21); and a second voltage dividing circuit (40) connected between an input of the fourth voltage buffer circuit (22) and an output of the second voltage buffer circuit (12), the second voltage dividing circuit being approximately same as the first voltage dividing circuit.

In the 10th aspect of the present invention, there is provided a reference potential generating circuit as defined in the 9th aspect. This circuit further comprises a first compensating resistor (R28) connected between the output of the first voltage buffer circuit (11) and an input of the third voltage buffer circuit (21).

With the 10th aspect of the present invention, the resistance value of the fifth resistor may be equal to that of the seventh resistor.

In the 11th aspect of the present invention, there is provided a reference potential generating circuit as defined in the 10th aspect. This circuit further comprises a second compensating resistor (R29) connected between an input of the fourth voltage buffer circuit (22) and the output of the second voltage buffer circuit (12).

With the 11th aspect of the present invention, the freedom of design can be increased since the number of design parameters increases by the second compensating resistor (R29).

In the 12th aspect of the present invention, there is provided a reference potential generating circuit as defined in the 9th aspect, wherein each of the first and second voltage dividing circuit (30 and 40) comprises a plurality of voltage dividing resistors connected in series and a plurality of voltage buffer circuits each of which is connected at a node between corresponding adjacent two of the voltage dividing resistors to provide a divided potential.

In the 13th aspect of the present invention, there is provided a reference potential generating circuit as defined in the 1st aspect, wherein the inside reference potential generating circuit (20B) comprises: a combined resistor having first and second resistors connected in parallel, the first resistor having a variable resistor (RV) for adjustment; a third resistor (R26 and R16) connected between a first power source potential (VDD) and the combined resistor; a fourth resistor (R27) connected between the combined resistor and a second power source potential (GND); a first voltage buffer circuit (21) connected at a tap of the third resistor (R26 and R16), for providing one (V4) of the inside reference potentials; and a second voltage buffer circuit (22) connected at a tap of the second resistor (R23 and R24), for providing the other (V5) of the inside reference potentials.

In the 14th aspect of the present invention, there is provided a reference potential generating circuit as defined in the 13th aspect, wherein the outside reference potential generating circuit (10A) comprises: a fifth through a seventh resistors (R11, R25 and R21) connected in series between the first and second power source potentials; a third voltage buffer circuit (11), connected at a node between the fifth resistor and the sixth resistor, for providing the one (V0) of the outside reference potentials, and a fourth voltage buffer circuit (12), connected at a node between the sixth resistor and the seventh resistor, for providing the other (V9) of the outside reference potentials.

In the 15th aspect of the present invention, there is provided a reference potential generating circuit as defined in the 14th aspect. This circuit further comprises: a first voltage dividing circuit (30) connected between an output of the first voltage buffer circuit (11) and an output of the third voltage buffer circuit (21); and a second voltage dividing circuit (40) connected between an output of the fourth voltage buffer circuit (22) and an output of the second voltage buffer circuit (12), the second voltage dividing circuit being approximately same as the first voltage dividing circuit.

In the 16th aspect of the present invention, there is provided a reference potential generating circuit as defined in the 15th aspect. This circuit further comprises a first compensating resistor (R28) connected between the output of the first voltage buffer circuit (11) and an input of the third voltage buffer circuit (21).

In the 17th aspect of the present invention, there is provided a reference potential generating circuit as defined in the 6th aspect. This circuit further comprises a second compensating resistor (R29) connected between the combined resistor and the output of the second voltage buffer circuit (12).

In the 18th aspect of the present invention, there is provided a reference potential generating circuit as defined in the 15th aspect, wherein each of the first and second voltage dividing circuit (30 and 40) comprises a plurality of voltage dividing resistors connected in series and a plurality of voltage buffer circuits each of which connected at a node between corresponding adjacent two of the voltage dividing resistors to provide a divided potential.

In the 19th aspect of the present invention, there is provided a liquid crystal display apparatus comprising: a liquid crystal display panel provided with data electrodes and scanning electrodes; a reference potential generating circuit including: an outside reference potential generating circuit (10) for generating a pair of outside reference potentials (V0and V9); and an inside reference potential generating circuit (20) for generating a pair of inside reference potentials which are between the outside reference potentials (V4and V5); wherein the outside reference potential generating circuit (10) includes: a combined resistor having first and second resistors connected in parallel, the first resistor having a variable resistor (RV) for adjustment; a third resistor (R11) connected between a first power source potential (VDD) and the combined resistor; a fourth resistor (R25 and R21) connected between the combined resistor and a second power source potential (GND); a first voltage buffer circuit (11) connected at a tap of the second resistor (R23 and R24), for providing one (V0) of the outside reference potentials; and a second voltage buffer circuit (12) connected at a tap of the fourth resistor (R23 and R24), for providing the other (V9) of the outside reference potentials; a data driver for applying one of the outside or inside reference potentials, a divided potential between the one (V0) of the outside reference potentials and one (V4) of the inside reference potentials, or a divided potential between the other (V5) of the inside reference potentials and the other (V9) of the outside reference potentials onto each of the data electrodes in compliance with display data; and a scanning driver for cyclically providing scanning pulses to the scanning electrodes.

In the 20th aspect of the present invention, there is provided a liquid crystal display apparatus comprising: a liquid crystal display panel provided with data electrodes and scanning electrodes; a reference potential generating circuit including: an outside reference potential generating circuit (10A) for generating a pair of outside reference potentials (V0 and V9); and an inside reference potential generating circuit (20B) for generating a pair of inside reference potentials which are between the outside reference potentials (V4 and V5); wherein the inside reference potential generating circuit (20B) comprises: a combined resistor having first and second resistors connected in parallel, the first resistor having a variable resistor (RV) for adjustment; a third resistor (R26 and R16) connected between a first power source potential (VDD) and the combined resistor; a fourth resistor (R27) connected between the combined resistor and a second power source potential (GND); a first voltage buffer circuit (21) connected at a tap of the third resistor (R26 and R16), for providing one (V4) of the inside reference potentials; and a second voltage buffer circuit (22) connected at a tap of the second resistor (R23 and R24), for providing the other (V5) of the inside reference potentials; a data driver for applying one of the outside or inside reference potentials, a divided potential between one (V0) of the outside reference potentials and one (V4) of the inside reference potentials, or a divided potential between the other (V5) of the inside reference potentials and the other (V9) of the outside reference potentials onto each of the data electrodes in compliance with display data; and a scanning driver for cyclically providing scanning pulses to the scanning electrodes.

In the 21st aspect of the present invention, there is provided a method for driving a liquid crystal display apparatus, comprising the steps of: generating a pair of outside reference potentials (V0 and V9) and a pair of inside reference potentials (V4 and V5) between the outside reference potentials; and correcting a deviation of a center potential ((V0+V9)/2 or (V4+V5)/2) of the outside or inside reference potentials in compliance with changes of the outside or inside reference potentials.

Other aspects, objects, and the advantages of the present invention will become apparent from the following detailed description taken in connection with the accompanying drawings.

DESCRIPTION OF THE PREFERRED EMBODIMENTS

Figure 1:
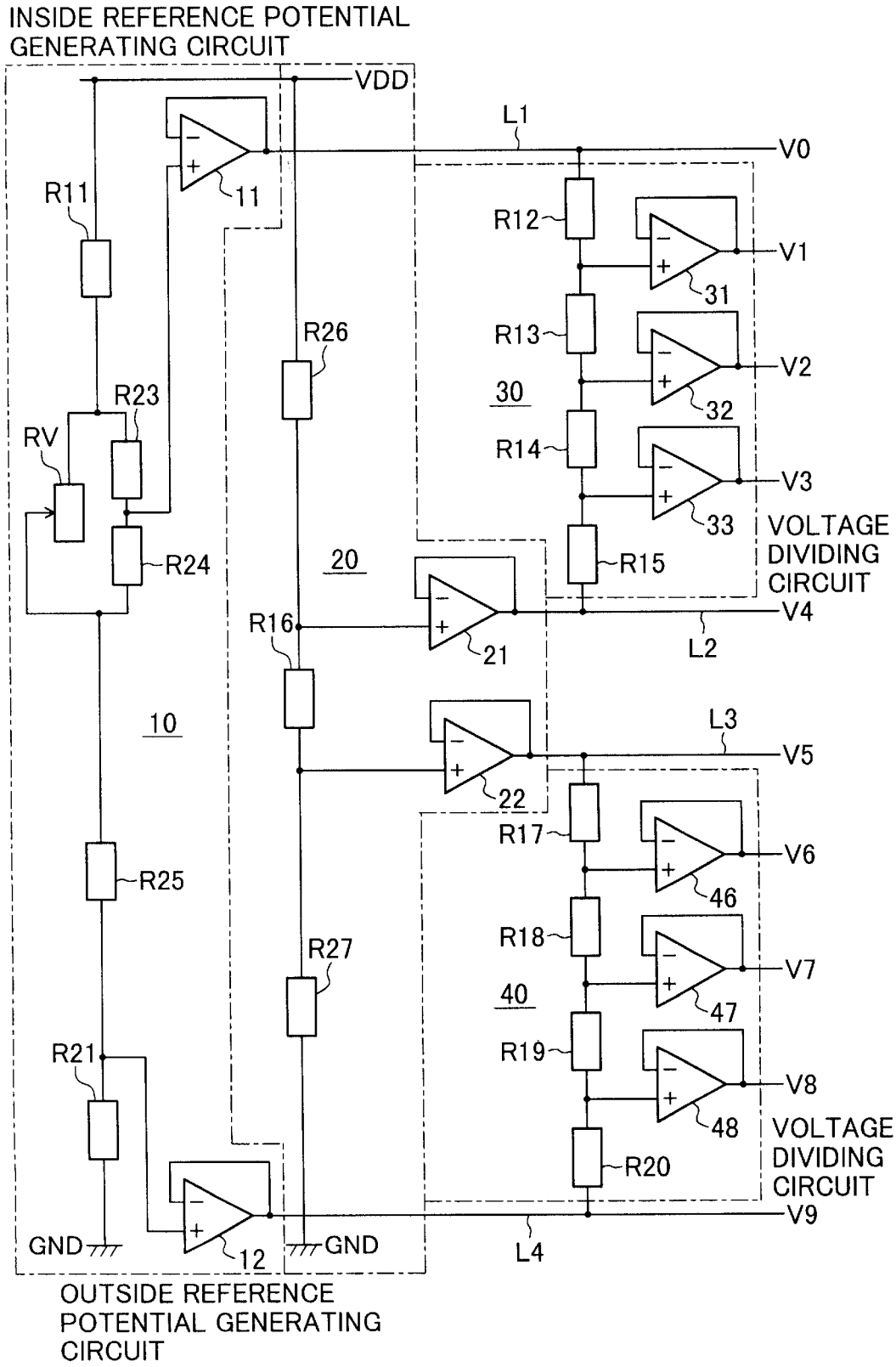
FIG. 1 is a diagram showing a reference potential generating circuit according to a first embodiment of the present invention.

Referring now to the drawings, wherein like reference characters designate like or corresponding parts throughout several views, preferred embodiments of the present invention are described below.

First Embodiment

Figure 8:
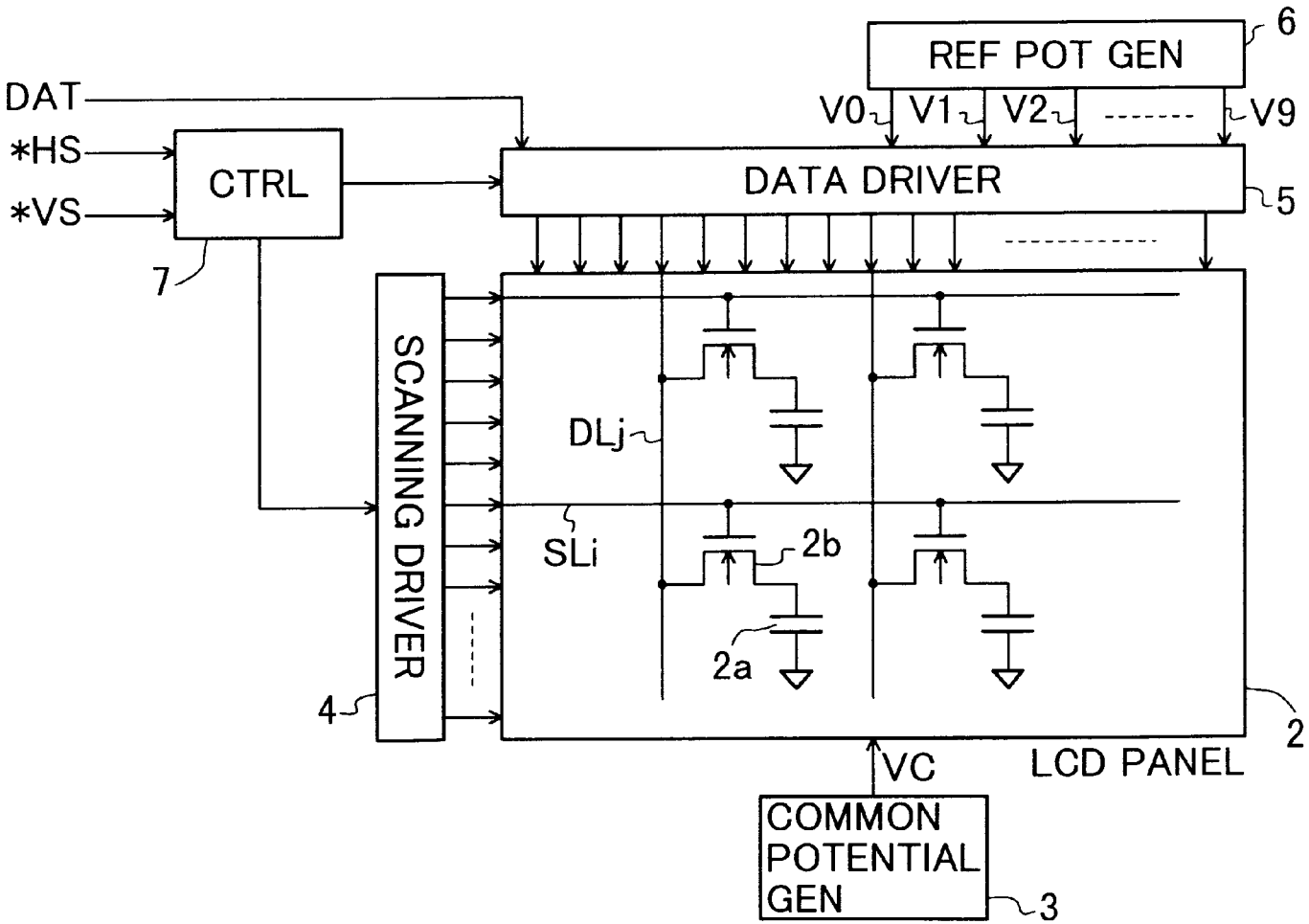
FIG.8 prior art
FIG. 8 is a schematic diagram showing a prior art liquid crystal display apparatus.

FIG. 1 shows a reference potential generating circuit according to a first embodiment of the present invention, which is used in, for example, a liquid crystal display apparatus of FIG. 8.

In FIG. 1, R11 through R21 and R23 through R27 are fixed resistors for voltage dividing, RV is a resistor to compensate ΔVgsd. Components 11, 12, 21, 22, 31 through 33 and 46 through 48 are voltage follower circuits for voltage buffering with amplification factor of 1.

Outside reference potential generating circuit 10 is to generate reference potentials V0 and V9 of the maximum voltage (V0–V9), in which a resistor R11, a combined resistor, resistors R21 and R25 for voltage dividing are connected in series between the power source potential VDD and ground potential GND. The combined resistor is such that a variable resistor RV is connected in parallel to resistors R23 and R24 connected in series. Variable resistor RV is to thoroughly adjust V0 through V9 so as to meet the above-mentioned equation (1). A node potential between resistors R23 and R24 is picked up in wiring L1 via voltage follower circuit 11 as V0. A node potential between resistors R21 and R25 is picked up in wiring L4 via voltage follower circuit 12 as V9.

Inside reference potential generating circuit 20 is to generate fixed reference potentials V4 and V5, not depending on adjustment of variable resistor RV. Resistors R26, R16 and R27 for voltage dividing are connected in series between VDD and GND. A node potential between resistors R26 and R16 is picked up in wiring L2 via voltage follower circuit 21 as V4, and a node potential between resistors R16 and R27 is picked up in wiring L3 via voltage follower circuit 22 as V5.

Voltage dividing circuit 30 divides voltage between V0 and V4 and is to generate reference potentials V1, V2 and V3, wherein resistors R12 through R15 are connected in series between wiring L1 and L2. Node potentials between resistors R12 and R13, between resistors R13 and R14 and between resistors R14 and R15 are respectively picked up via voltage follower circuits 31, 32, and 33 as V1, V2 and V3.

Similarly, voltage dividing circuit 40 divides voltage between reference potentials V5 and V9 and is to generate reference potentials V6, V7, and V8, wherein resistors R17 through R20 are connected in series between wiring L3 and L4. Node potentials between resistors R17 and R18, between resistors R18 and R19 and between resistors R19 and R20 are respectively picked up via voltage follower circuits 46, 47, and 48 as V6, V7 and V8.

In the reference potential generating circuit constructed as described above, if the resistance value of combined resistor increases by increasing the resistance value of variable resistor RV, electric current flowing through R21 decreases, thereby lowering V9 . Although the ratio of electric current flowing through R23 to the electric current flowing through RV increases by increasing the resistance value of RV, the voltage variation of R23 with respect to changes of RV is made small by making the resistance ratio R23/R24 small. Thereby, the electric current flowing through R11 decreases and V0 rises by increasing the resistance value of RV. The shifting up amount ΔV0 of V0 is smaller than the shifting down amount ΔV9 of V9. Therefore, "$\mu$" in the above-mentioned equation (1) becomes positive.

Furthermore, with respect to ΔV in equation (1), the resistance value of R26 is made smaller than that of R27 to raise the center potential (V4+V5)/2 between V4 and V5.

On the basis of the above, equation (1) can be satisfied. Therefore, even though a plurality of reference potentials are thoroughly adjusted by variable resistor RV, a deviation of the center potential of a pair of reference potentials from a common potential CV of the liquid crystal pixel opposite electrode can be compensated, thereby the above-mentioned image can be prevented from flickering and residual image, and the display quality of liquid crystal display apparatus can be improved.

Calculation equations of V0 through V9 are as follows:

With respect to V0 and V9, the following equations hold, $$V0=(R24A+R25+R21)*VDD/R11_R21 \quad (2)$$

$$V9=R21*VDD/R11_R21 \quad (3)$$

wherein * is a multiply operator,

R12_R15=R12+R13+R14+R15,

R17_R20=R17+R18+R19+R20,

RVA=RV*(R23+R24)/(RV+R23+R24),

R24A=RVA*R24/(R23+R24), and

R11_R21=R11+RVA+R25+R21.

With respect to V4 and V5, the following equations hold;

$$V4=VDD-R26*L1 \quad (4)$$

$$V5=R27*L1 \quad (5)$$

wherein L1=VDD/(R26+R16+R27).

With respect to V1 through V3 and V6 through V8, the following equations hold.

$$V1=((R13+R14+R15)*V0+R12*V4)/R12_R15 \quad (6)$$

$$V2=((R14+R15)*V0+(R12+R13)*V4)/R12_{13}\ R15 \quad (7)$$

$$V3=(R15*V0+(R12+R13+R14)*V4)/R12_R15 \quad (8)$$

$$V6=((R18+R19+R20)*V5+R17*V9)/R17_R20 \quad (9)$$

$$V7=((R19+R20)*V5+(R17+R18)*V9)/R17_R20 \quad (10)$$

$$V8=(R20*V5+(R17+R18+R19)*V9)/R17_R20 \quad (11)$$

In a case where variable resistor RV was changed in a range from 0 to 100 kΩ in the above-mentioned calculation equations, using the resistance values shown in Table I, the results of calculation shown in Table II was obtained.

TABLE I

| | | | | | | | UNIT |
|---|---|---|---|---|---|---|---|
| | MAX. VOLTAGE | 11.2 | 10.5 | 10.0 | 9.5 | 9.2 | V |
| | VAR. RESIST. | 100.0 | 24.0 | 10.0 | 2.7 | 0.0 | kΩ |
| (Vu − Vd)/2 | (V0 − V9)/2 | 5.60 | 5.25 | 5.00 | 4.75 | 4.62 | V |
| | (V1 − V8)/2 | 4.56 | 4.31 | 4.13 | 3.94 | 3.84 | |
| | (V2 − V7)/2 | 2.72 | 2.63 | 2.57 | 2.51 | 2.48 | |
| | (V3 − V6)/2 | 2.26 | 2.22 | 2.19 | 2.16 | 2.14 | |
| | (V4 − V5)/2 | 1.79 | 1.79 | 1.79 | 1.79 | 1.79 | |
| (Vu + Vd)/2 | (V0 + V9)/2 | 5.97 | 5.98 | 5.99 | 6.00 | 6.00 | V |
| | (V1 + V8)/2 | 6.00 | 6.01 | 6.01 | 6.02 | 6.02 | |
| | (V2 + V7)/2 | 6.05 | 6.06 | 6.06 | 6.06 | 6.06 | |
| | (V3 + V6)/2 | 6.07 | 6.07 | 6.07 | 6.07 | 6.07 | |

TABLE II

| RESISTOR | kΩ |
|---|---|
| R11 | 2.7 |
| R12 | 5.1 |
| R13 | 8.2 |
| R14 | 2 |
| R15 | 2 |
| R16 | 15 |
| R17 | 2 |
| R18 | 2 |
| R19 | 8.2 |
| R20 | 5.1 |
| R21 | 2.7 |
| RVmax | 100 |
| R23 | 1.2 |
| R24 | 180 |
| R25 | 18 |
| R26 | 17.3 |
| R27 | 18 |

Figure 2:
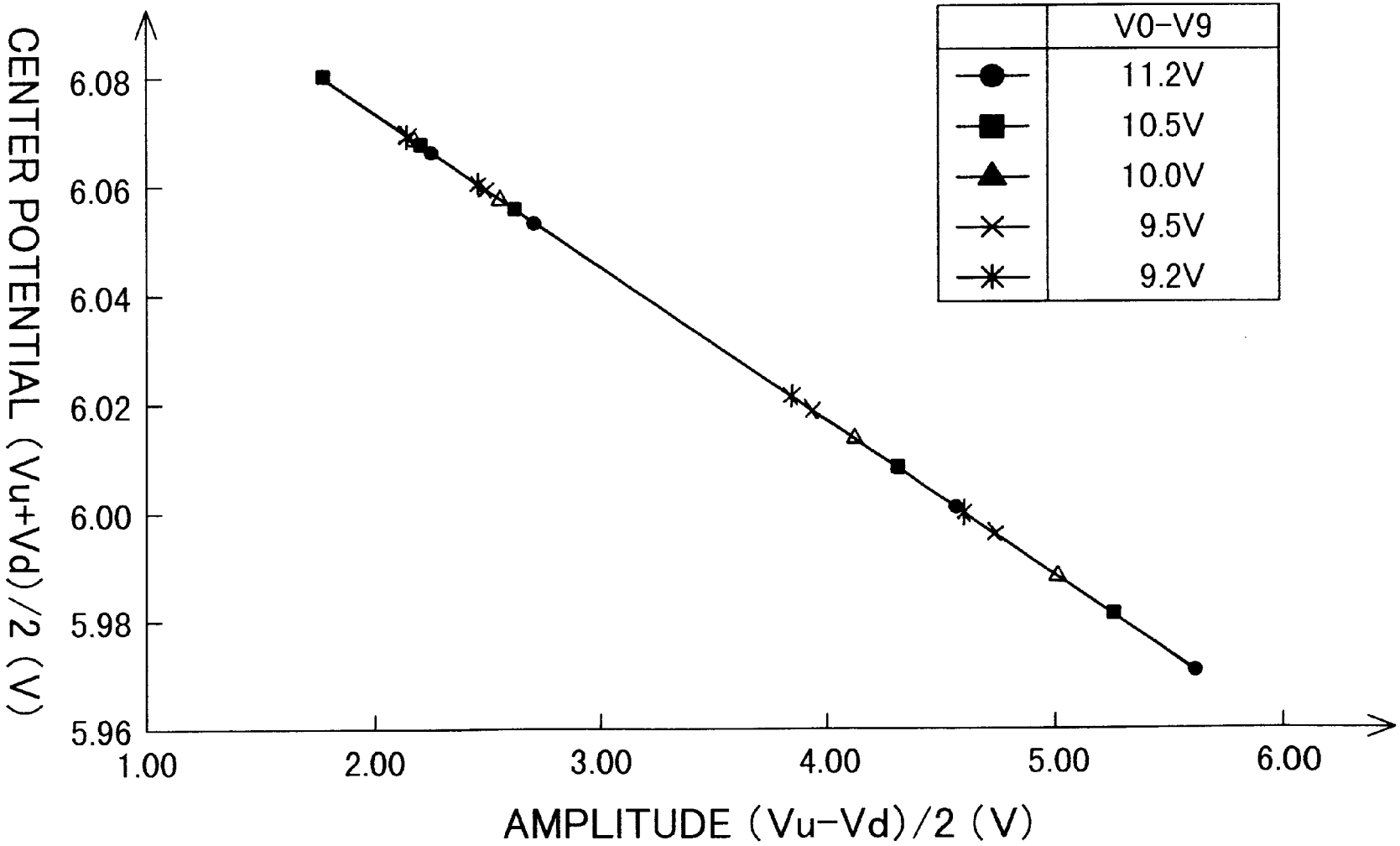
FIG. 2 is a diagram showing the center potential with respect to the amplitude of a pair of reference potentials when the maximum voltage (V0–V9) is changed.

FIG. 2 expresses this table in a form of graph. The vertical axis is the center potential (Vu+Vd)/2 of a pair of reference potentials, and the horizontal axis is the amplitude (Vu−Vd)/2 of a pair of reference potentials, wherein Vu=V0, V1, V2 or V4 and Vd=V9, V8, V7, V6 or V5, respectively.

As a result, FIG. 2 means the following:

(1) When variable resistor RV is changed in a range from 0 to 100 kΩ, the maximum voltage (V0–V9) changes in a range from 9.2V to 11.2V.

(2) Even if the maximum voltage (V0–V9) is changed, the relationship between (Vu−Vd)/2 and (Vu+Vd)/2 is expressed by the same straight line to cause the above-mentioned equation (1) to be satisfied. Therefore, the above-mentioned effect can be obtained.

Second Embodiment

Figure 3:
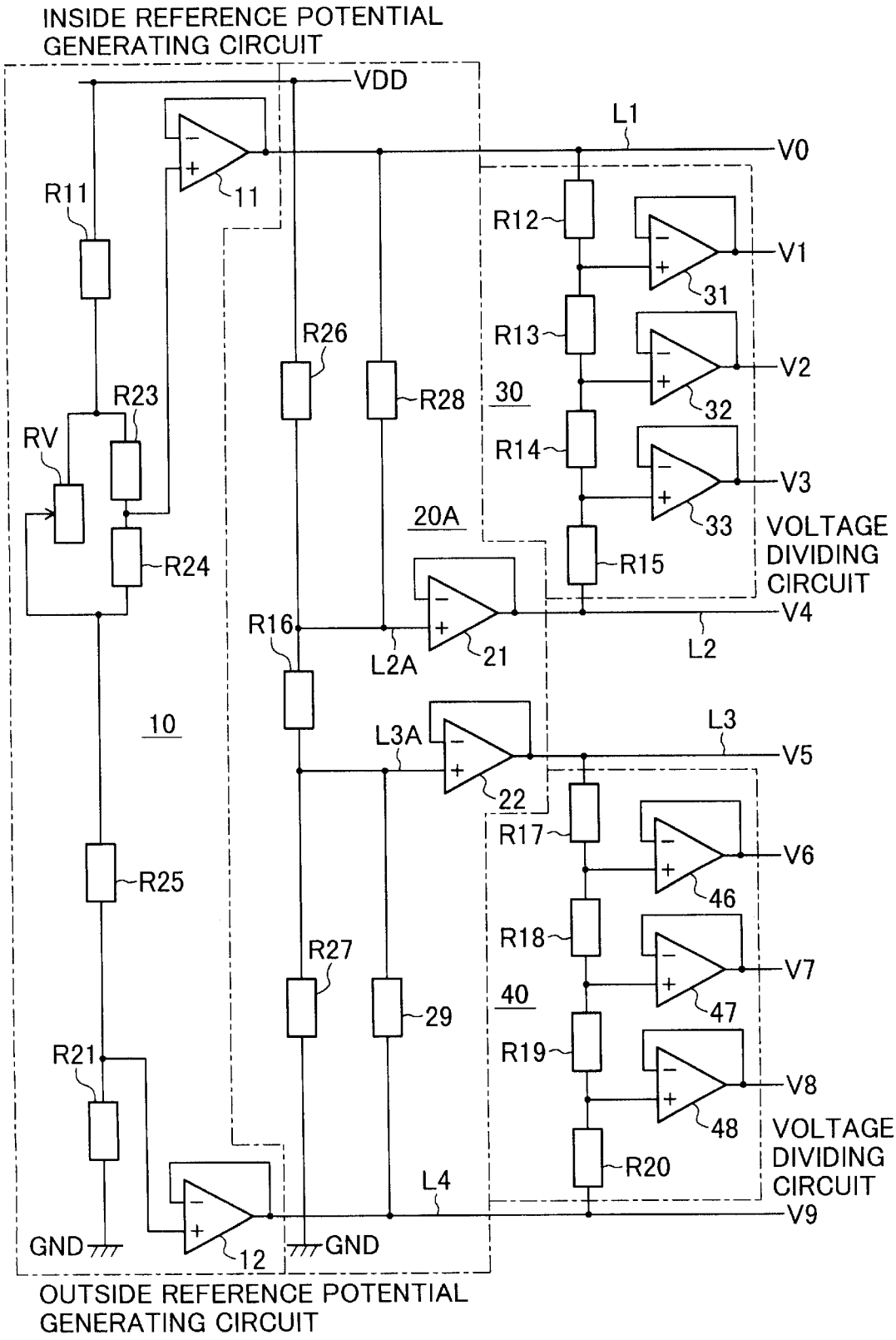
FIG. 3 is a diagram showing a reference potential generating circuit according to a second embodiment of the present invention.

FIG. 3 shows a reference potential generating circuit according to a second embodiment of the present invention.

In the inside reference potential generating circuit 20A, resistor R28 is connected between wiring L1 and L2A, and resistor R29 is connected between wiring L3A and L4. Since the electric current flowing through R12 through R15 is decreased by bypass of R28, each of V1 through V4 is raised and the center potential (Vu+Vd)/2 is raised. Therefore, condition R26<R27, which is necessary in the above-mentioned first embodiment, is not required. By this raising, the number of adjustment parameters at a specified resistance value of RV increases by adding R29, although R29 is not a requisite. R28<R29 is necessary to carry out this raising.

In this case, V0 through V9 are expressed by the following calculation equations:

V0 and V9 are respectively expressed by the above-mentioned equations (2) and (3).

With respect to V4 and V5, the following equations hold;

$$V4=VDD-R26*L1 \quad (14)$$

$$V5=R27*L3 \quad (15)$$

wherein $$L1=(VDD-V0+R28*L2)/(R26+R28),$$

$$L2=L2C/L2P,$$

$$L2C=VDD-R26/(R26+R28)*(VDD-V0)-R27/(R27+R29)*V0,$$

$$L2P=R26*R28/(R26+R28)+R16+R27*R29/(R27+R29),$$

and $$L3=(V9+R29*L2)/(R27+R29).$$

V1 through V3 and V6 through V8 are expressed by the above-mentioned equations (6) through (11), respectively.

With this second embodiment, effects similar to those of the above-mentioned first embodiment can be obtained.

Third Embodiment

Figure 4:
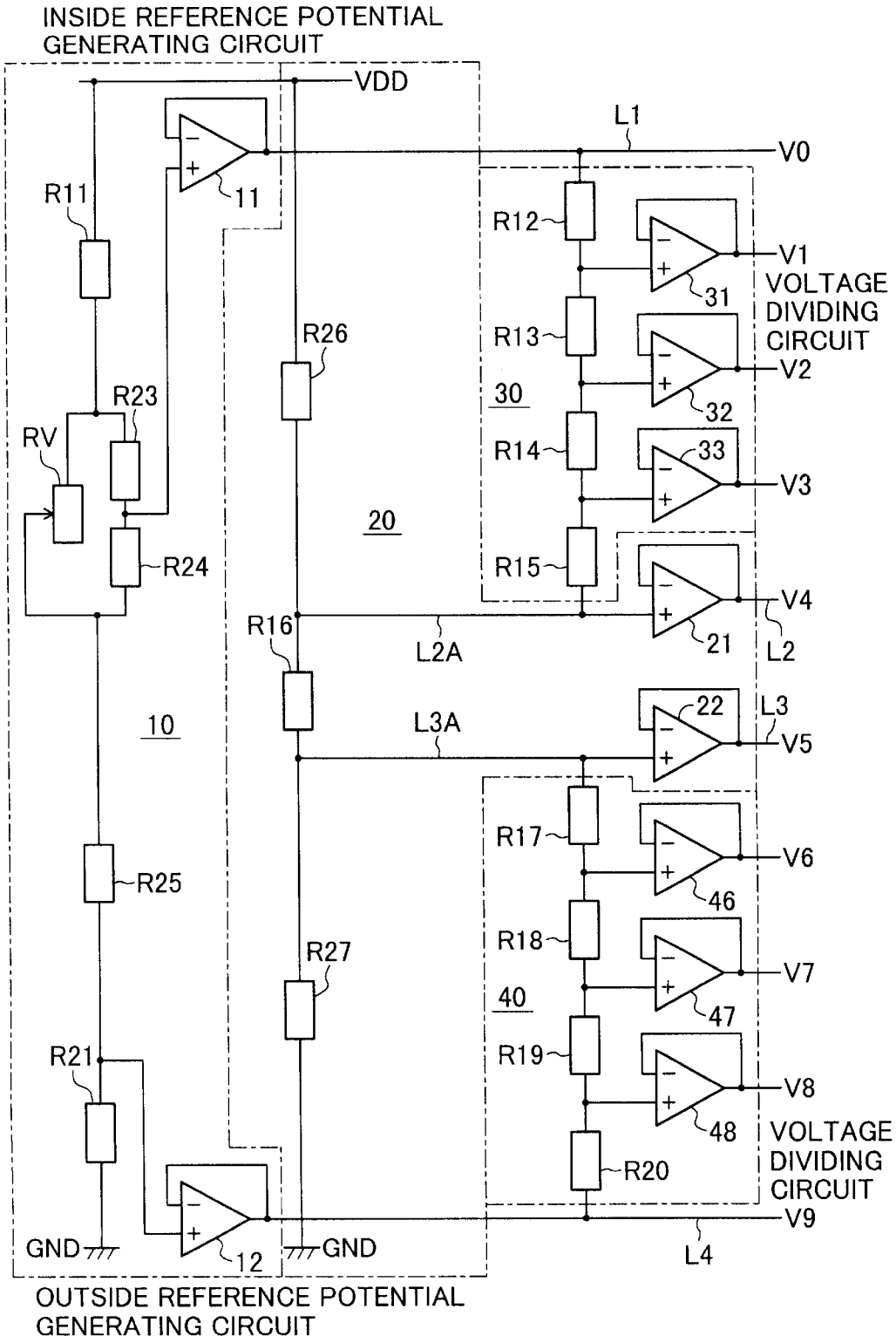
FIG. 4 is a diagram showing a reference potential generating circuit according to a third embodiment of the present invention.

FIG. 4 shows a reference potential generating circuit according to a third embodiment of the present invention.

In FIG. 1, one ends of resistors R15 and R17 are respectively connected to outputs of voltage follower circuits 21 and 22, while in FIG. 4 one ends of R15 and R17 are respectively connected to inputs of voltage following circuits 21 and 22. All the other points are identical to those in FIG. 1, and the relation R26<R27 remains.

In this case, V0 through V9 are expressed by the following calculation equations:

V0 and V9 are expressed by the above-mentioned equations (2) and (3).

With respect to V4 and V5, the following equations hold;

$$V4=VDD-R26*L1 \quad (24)$$

$$V5=R27*L3 \quad (25)$$

wherein $$L1=(VDD-V0+R12_R15*L2)/(R26+R12_R15),$$

$$L2=L2C/L2P,$$

$$L2C=VDD-R26/(R26+R12_R15)*(VDD-V0)-R27/(R27+R17_R20)*V0,$$

$$L2P=R26*R12_R15/(R26+R12_R15)+R16+R27*R17_R20/(R27+R17\ R20), \text{ and}$$

$$L3=(V9+R17_R20*L2)/(R27+R17_R20).$$

V1 through V3 and V6 through V8 are expressed by the above-mentioned equations (6) through (11), respectively.

In this third embodiment, effects similar to those of the above-mentioned first embodiment can be obtained.

Fourth Embodiment

Figure 5:
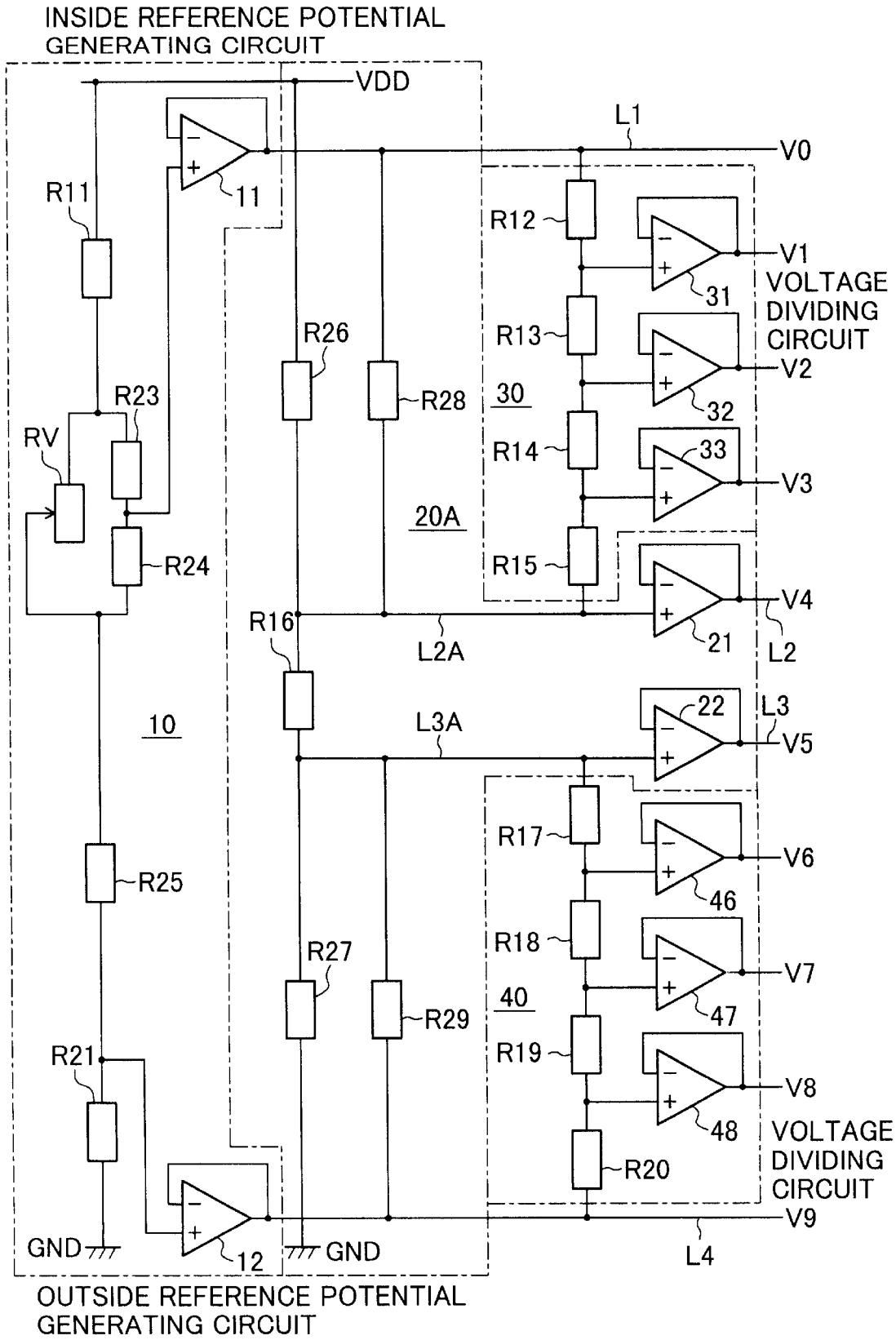
FIG. 5 is a diagram showing a reference potential generating circuit according to a fourth embodiment of the present invention.

FIG. 5 shows a reference potential generating circuit of a fourth embodiment of the present invention.

With this circuit, in the inside reference potential generating circuit 20A, resistor R28 is connected between wiring L1 and L2A, and resistor R29 is connected between wiring L3A and L4. With R28, even if R26=R27 holds, V1 through V4 is raised as in the case where R26<R27 without R28.

In this case, V0 through V9 are expressed by the following equations:

V0 and V9 are respectively expressed by the above-mentioned equations (2) and (3).

With respect to V4 and V5, the following equations hold;

$$V4=VDD-R26*L1 \quad (24)$$

$$V5=R27*L3 \quad (25)$$

wherein $$L1=(VDD-V0+R28A*L2)/(R26+R28A),$$

$$R28A=R28*R12_R15/(R28+R12_R15),$$

$$L3=(V9+R29A*L2)/(R27+R29A),$$

$$R29A=R29*R17_R20/(R29+R17_R20),$$

$$L2=L2C/L2P,$$

$$L2C=VDD-R26/(R26+R28A)*(VDD-V0)-R27/(R27+R29A)*V0, \text{ and}$$

$$L2P=R26*R28A/(R26+R28A)+R16+R27*R29A/(R27+R29A).$$

V1 through V3 and V6 through V8 are respectively expressed by the above-mentioned equations (6) through (11).

In this fourth embodiment, effects similar to those of the above-mentioned first embodiment can be obtained.

Fifth Embodiment

Figure 6:
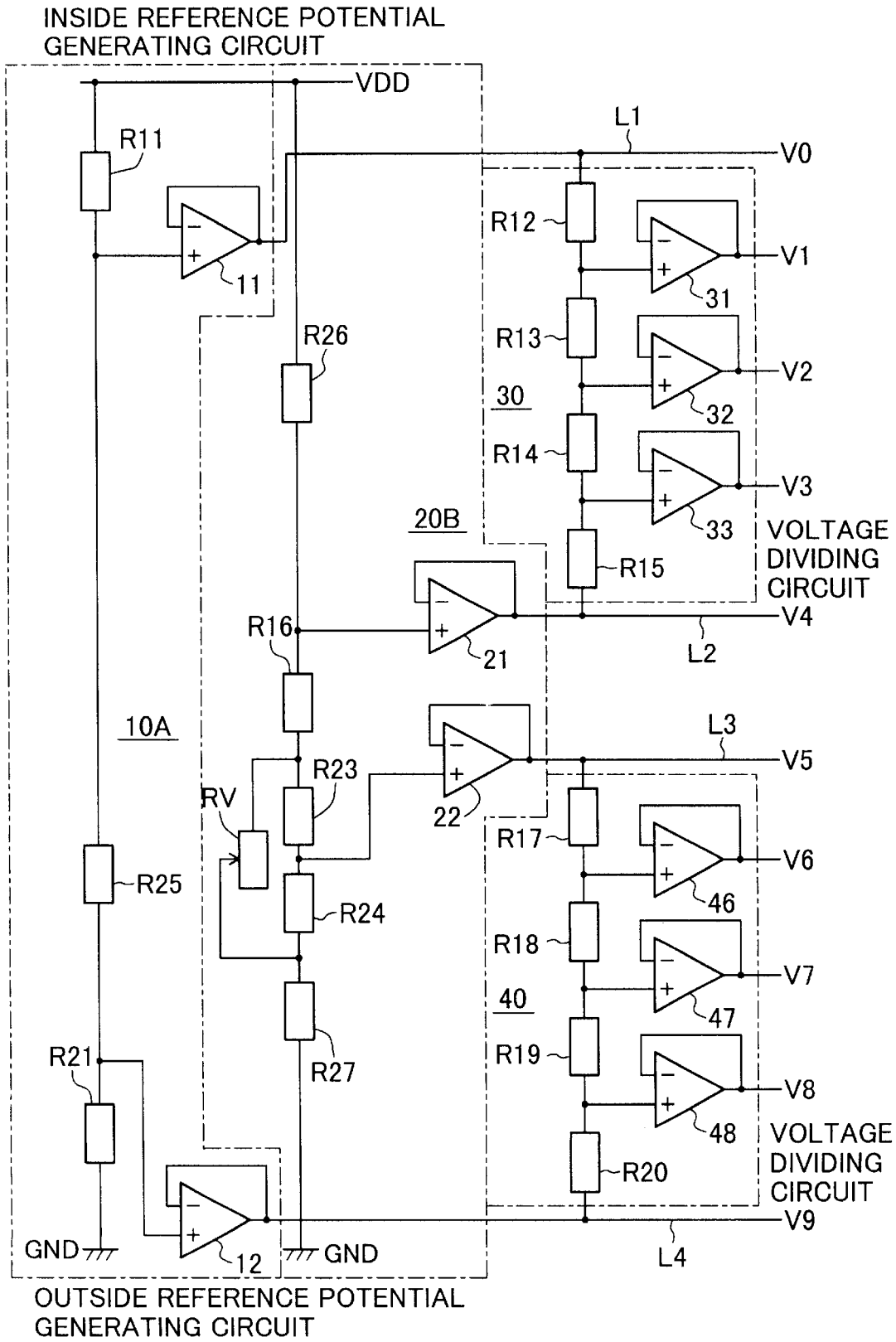
FIG. 6 is a diagram showing a reference potential generating circuit according to a fifth embodiment of the present invention.

FIG. 6 shows a reference potential generating circuit of a fifth embodiment of the present invention.

Figure 9:
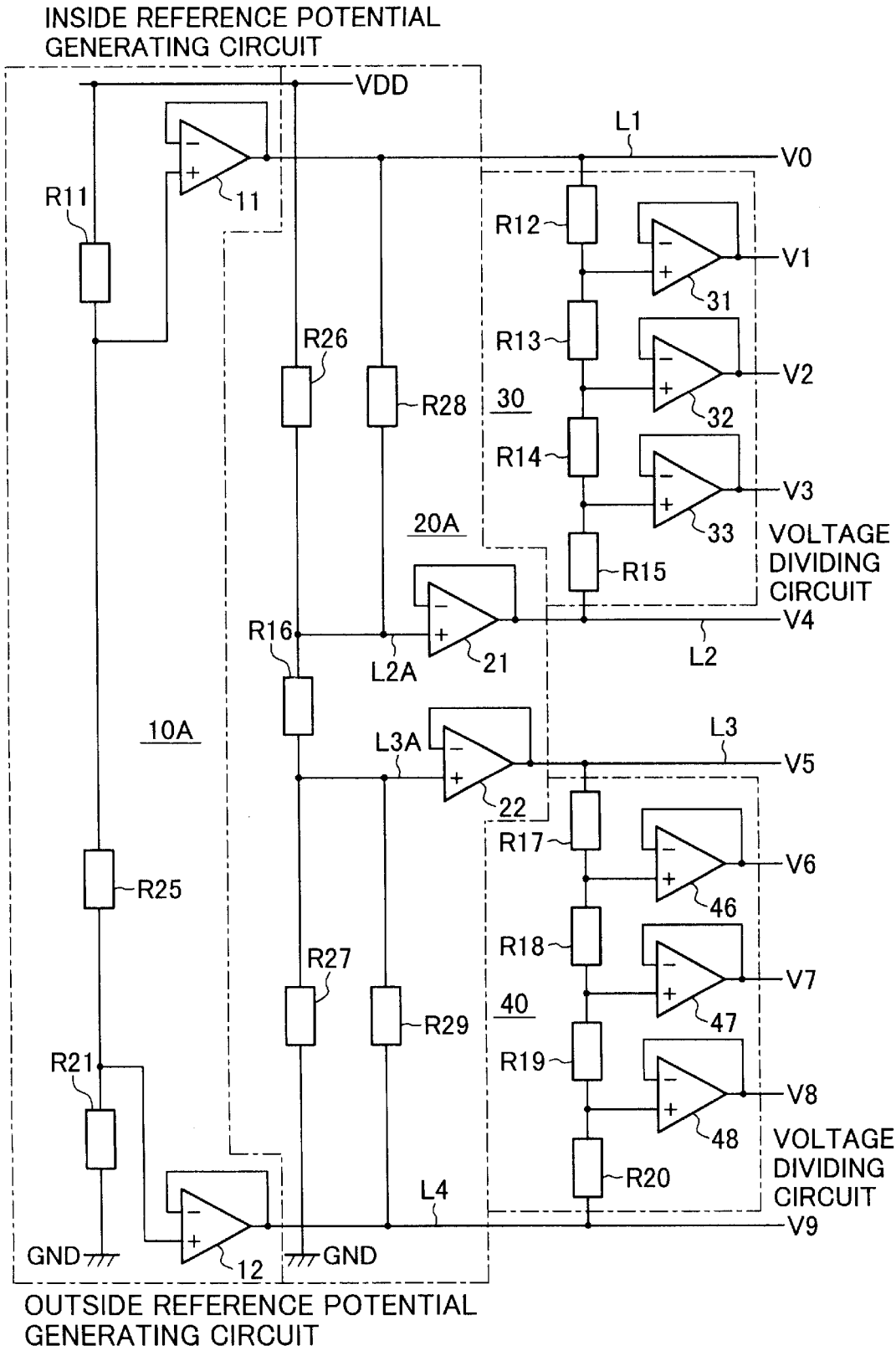
FIG.9 prior art
FIG. 9 is a diagram showing a prior art reference potential generating circuit.
Figure 10:
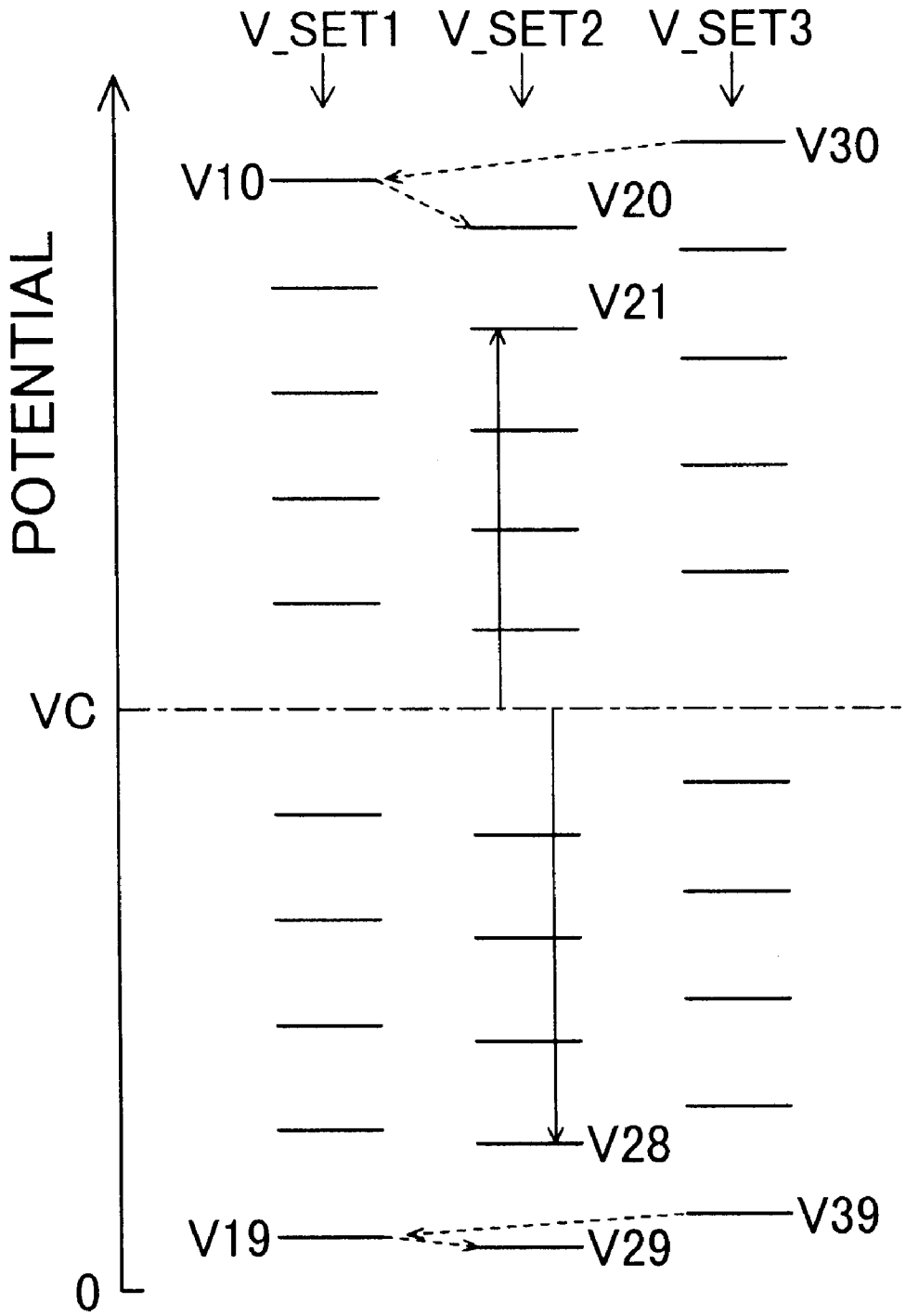
FIG.10 prior art
FIG. 10 is a diagram illustrating a prior art problem.

The increase/decrease relation between liquid crystal application voltage and optical transmittance is reversed depending on the kinds of liquid crystal. In a reverse relation., it is necessary to keep V0 and V9 fixed regardless of the resistance value of variable resistor RV and to change V4 and V5 according to adjustments of variable resistor RV. A circuit of FIG. 6 is to achieve this. The outside reference potential generating circuit 10A is identical to that of FIG. 9, which generates fixed V0 and V9.

The inside reference potential generating circuit 20B is such that, instead of R16 of FIG. 1, R16 and the above-mentioned combined resistor are connected in series and a node potential between resistors R23 and R24 of the combined resistor is picked up in wiring L3 via voltage follower circuit 22 as V5.

All the other constructions are identical to those of the above-mentioned first embodiment.

If the resistance value of the combined resistor increases by increasing the resistance value of variable resistor RV, electric current flowing through R26 decreases and thereby V4 rises. Although the ratio of electric current flowing through R24 to the electric current flowing to variable resistor RV increases by increasing the resistance value of variable resistor RV, the voltage variation of R24 with respect to changes of variable resistor RV is made small by making the resistance ratio R24/R23 small. Thereby, V5 is lowered if the resistance value of variable resistor RV increases. The shifting down amount ΔV5 of V5 is smaller than the shifting up amount ΔV4 of V4. Therefore, "$\mu$" in the above-mentioned equation (1) becomes positive.

Furthermore, with respect to ΔV in equation (1), the resistance value of R26 is made smaller than the sum of the resistance of R27 and equivalent resistance R24A of R24 to raise the center potential (V4+V5)/2 between V4 and V5.

Based on the above description, it is possible to meet equation (1). Therefore, a deviation of the center potential with respect to the common potential VC can be adequately compensated by adjusting variable resistor RV, thereby image can be prevented from flickering and being residual, and the display quality of liquid crystal display apparatus can be improved.

Calculation equations of V0 through V9 are as follows:

With respect to V0 and V9, the following equations hold;

$$V0=(R25+R21)*VDD/R11_R21 \quad (32)$$

$$V9=R21*VDD/R11_R21 \quad (33)$$

wherein R11_R21=R11+R25+R21.

With respect to V4 and V5, the following equations hold;

$$V4=VDD-R26*L1 \quad (34)$$

$$V5=(R27+R24A)*L1 \quad (35)$$

wherein L1=VDD/(R26+R16+RVA+R27).

V1 through V3 and V6 through V8 are expressed by the above-mentioned equations (6) to (11), respectively.

Sixth Embodiment

Figure 7:
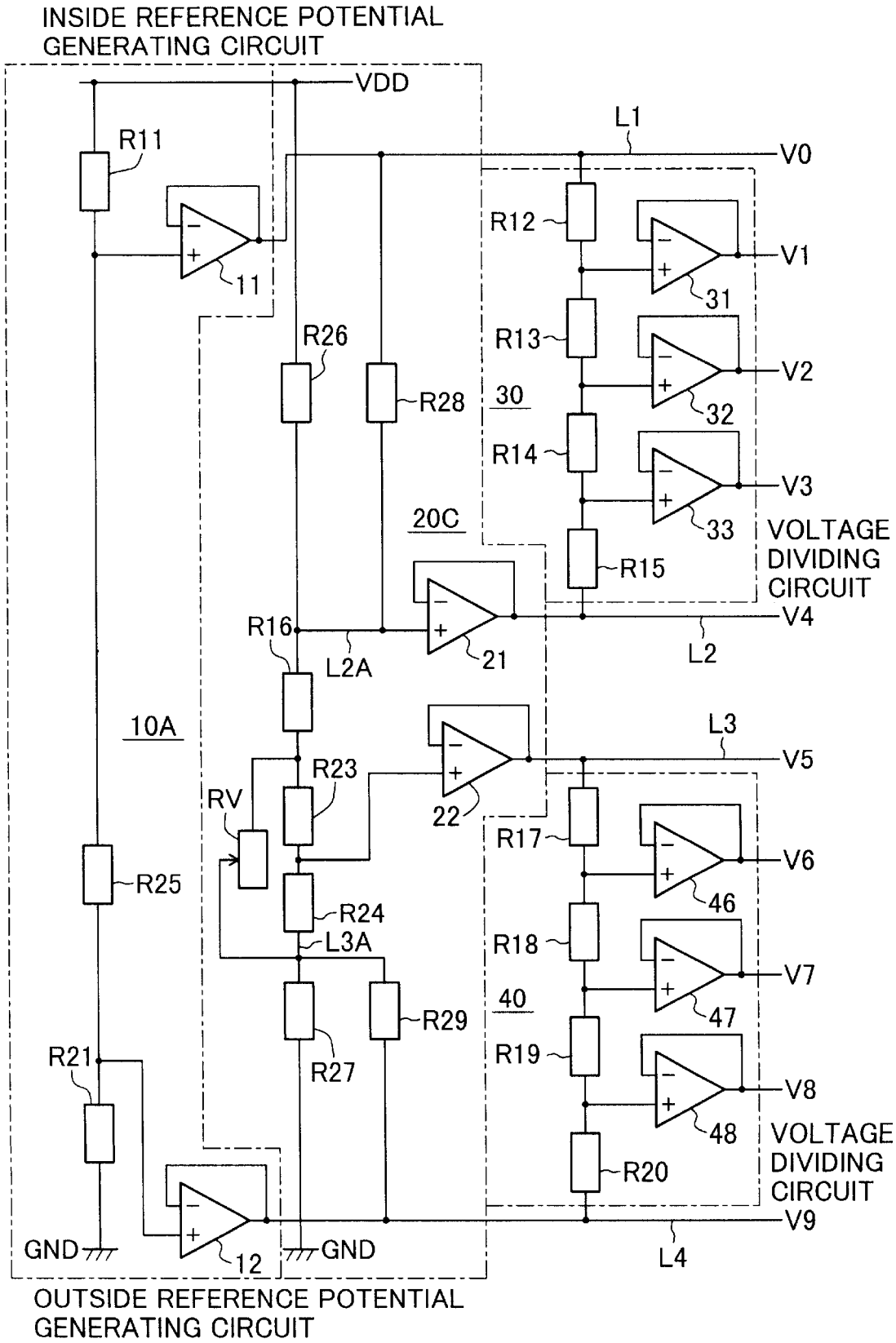
FIG. 7 is a diagram showing a reference potential generating circuit according to a sixth embodiment of the present invention.

FIG. 7 shows a reference potential generating circuit according to a sixth embodiment of the present invention.

In inside reference potential generating circuit 20C, resistor R28 is connected between wiring L1 and L2A, while resistor R29 is connected between wiring L3A and L4, where wiring L3A is between R24 and R27. In this case, V0 through V9 are expressed by the following calculation equations:

V0 and V9 are respectively expressed by the above-mentioned equations (32) and (33).

With respect to V4 and V5, $$V4=VDD-R26A*L1 \quad (44)$$

$$V5=(R27+R24A)*L3 \quad (45)$$

wherein $$L1=(VDD-V0+R28*L2)/(R26+R28),$$

$$L2=L2C/L2P,$$

$$L2C=VDD-R26/(R26+R28)*(VDD-V0)-(R27+R24A)/(R27+R24A+R29)*V0, \text{ and}$$

$$L2P=R26*R28/(R26+R28)+R16+RVA+R27*R29/(R27+R24A+R29)$$

$$L3=(V9+R29*L2)/(R27+R24A+R29).$$

V1 through V3 and V6 through V8 are respectively expressed by the above-mentioned equations (6) through (11).

In this sixth embodiment, effects which are similar to those of the above-mentioned fifth embodiment can be obtained.

Although preferred embodiments of the present invention has been described, it is to be understood that the invention is not limited thereto and that various changes and modifications may be made without departing from the spirit and scope of the invention.

For example, in FIG. 3, FIG. 5, and FIG. 7, R29 may be omitted. Furthermore, for adjustment prior to shipment, R23 or R24 may be composed of a pre-set variable resistor. The above-mentioned combined resistor may be such that R23 and R24 are connected in series and other resistors is connected thereto in parallel, wherein a variable resistor is included so as to cause the resistance value of the other resisters to be variable.

The voltage buffer circuit may be a source follower circuit, the construction of which is simpler than that of a voltage follower circuit, instead of the voltage follower circuit.

What is claimed is:

1. A reference potential generating circuit for liquid crystal display apparatus, comprising:

an outside reference potential generating circuit for generating a pair of outside reference potentials;

an inside reference potential generating circuit for generating a pair of inside reference potentials each of which is between said outside reference potentials; and wherein said outside or inside reference potential generating circuit includes a combined resistor having a variable first resistor connected in parallel with a second resistor for varying corresponding said outside or said inside reference potentials to correct a deviation of a center potential of said corresponding outside or inside reference potentials.

2. A reference potential generating circuit according to claim 1, wherein said outside reference potential generating circuit comprises:

said combined resistor;

a third resistor connected between a first power source potential and said combined resistor;

a fourth resistor connected between said combined resistor and a second power source potential;

a first voltage buffer circuit connected at a tap of said second resistor, for providing one of said outside reference potentials; and a second voltage buffer circuit connected at a tap of said fourth resistor, for providing the other of said outside reference potentials.

3. A reference potential generating circuit according to claim 2, wherein said inside reference potential generating circuit comprises:

a fifth through a seventh resistors connected in series between said first and second power source potentials, a third voltage buffer circuit, connected at a node between said fifth resistor and said sixth resistor, for providing said one of said inside reference potentials, and a fourth voltage buffer circuit, connected at a node between said sixth resistor and said seventh resistor, for providing said the other of said inside reference potentials.

4. A reference potential generating circuit according to claim 3, further comprising:

a first voltage dividing circuit connected between an output of said first voltage buffer circuit and an output of said third voltage buffer circuit; and a second voltage dividing circuit connected between an output of said fourth voltage buffer circuit and an output of said second voltage buffer circuit, said second voltage dividing circuit being approximately same as said first voltage dividing circuit.

5. A reference potential generating circuit according to claim 4, wherein a resistance value of said fifth resistor is lower than that of said seventh resistor.

6. A reference potential generating circuit according to claim 4, further comprising a first compensating resistor connected between said output of said first voltage buffer circuit and an input of said third voltage buffer circuit.

7. A reference potential generating circuit according to claim 6, further comprising a second compensating resistor connected between an input of said fourth voltage buffer circuit and said output of said second voltage buffer circuit.

8. A reference potential generating circuit according to claim 4, wherein each of said first and second voltage dividing circuit comprises a plurality of voltage dividing resistors connected in series and a plurality of voltage buffer circuits each connected at a node between corresponding adjacent two of said voltage dividing resistors to provide a divided potential.

9. A reference potential generating circuit according to claim 3, further comprising:

a first voltage dividing circuit connected between an output of said first voltage buffer circuit and an input of said third voltage buffer circuit; and a second voltage dividing circuit connected between an input of said fourth voltage buffer circuit and an output of said second voltage buffer circuit, said second voltage dividing circuit being approximately same as said first voltage dividing circuit.

10. A reference potential generating circuit according to claim 9, further comprising a first compensating resistor connected between said output of said first voltage buffer circuit and an input of said third voltage buffer circuit.

11. A reference potential generating circuit according to claim 10, further comprises a second compensating resistor connected between an input of said fourth voltage buffer circuit and said output of said second voltage buffer circuit.

12. A reference potential generating circuit according to claim 9, wherein each of said first and second voltage dividing circuit comprises a plurality of voltage dividing resistors connected in series and a plurality of voltage buffer circuits each connected at a node between corresponding adjacent two of said voltage dividing resistors to provide a divided potential.

13. A reference potential generating circuit according to claim 1, wherein said inside reference potential generating circuit comprises:

said combined resistor;

a third resistor connected between a first power source potential and said combined resistor;

a fourth resistor connected between said combined resistor and a second power source potential;

a first voltage buffer circuit connected at a tap of said third resistor for providing one of said inside reference potentials; and a second voltage buffer circuit connected at a tap of said second resistor, for providing the other of said inside reference potentials.

14. A reference potential generating circuit according to claim 13, wherein said outside reference potential generating circuit comprises:

a fifth through a seventh resistors connected in series between said first and second power source potentials;

a third voltage buffer circuit, connected at a node between said fifth resistor and said sixth resistor, for providing said one of said outside reference potentials, and a fourth voltage buffer circuit, connected at a node between said sixth resistor and said seventh resistor, for providing said the other of said outside reference potentials.

15. A reference potential generating circuit according to claim 14, further comprising:

a first voltage dividing circuit connected between an output of said first voltage buffer circuit and an output of said third voltage buffer circuit; and a second voltage dividing circuit connected between an output of said fourth voltage buffer circuit and an output of said second voltage buffer circuit, said second voltage dividing circuit being approximately same as said first voltage dividing circuit.

16. A reference potential generating circuit according to claim 15, further comprising a first compensating resistor connected between said output of said first voltage buffer circuit and an input of said third voltage buffer circuit.

17. A reference potential generating circuit according to claim 6, further comprising a second compensating resistor connected between said combined resistor and said output of said second voltage buffer circuit.

18. A reference potential generating circuit according to claim 15, wherein each of said first and second voltage dividing circuit comprises a plurality of voltage dividing resistors connected in series and a plurality of voltage buffer circuits each connected at a node between corresponding adjacent two of said voltage dividing resistors to provide a divided potential.

19. A liquid crystal display apparatus comprising:

a liquid crystal display panel provided with data electrodes and scanning electrodes;

a reference potential generating circuit including:

an outside reference potential generating circuit for generating a pair of outside reference potentials; and an inside reference potential generating circuit for generating a pair of inside reference potentials which are between said outside reference potentials and are independent of said outside reference potentials;

wherein said outside reference potential generating circuit includes:

a combined resistor having first and second resistors connected in parallel, said first resistor having a variable resistor for adjustment;

a third resistor connected between a first power source potential and said combined resistor;

a fourth resistor connected between said combined resistor and a second power source potential;

a first voltage buffer circuit connected at a tap of said second resistor, for providing one of said outside reference potentials; and a second voltage buffer circuit connected at a tap of said fourth resistor, for providing the other of said outside reference potentials;

a data driver for applying one of said outside and inside reference potentials, a divided potential between said one of said outside reference potentials and one of said inside reference potentials, or a divided potential between the other of said inside reference potentials and said the other of said outside reference potentials onto each of said data electrodes in compliance with display data; and a scanning driver for cyclically providing scanning pulses to said scanning electrodes.

20. A liquid crystal display apparatus comprising:

a liquid crystal display panel provided with data electrodes and scanning electrodes;

a reference potential generating circuit including:

an outside reference potential generating circuit for generating a pair of outside reference potentials; and an inside reference potential generating circuit for generating a pair of inside reference potentials which are between said outside reference potentials and are independent of said outside reference potentials;

wherein said inside reference potential generating circuit comprises:

a combined resistor having first and second resistors connected in parallel, said first resistor having a variable resistor for adjustment;

a third resistor connected between a first power source potential and said combined resistor;

a fourth resistor connected between said combined resistor and a second power source potential;

a first voltage buffer circuit connected at a tap of said third resistor, for providing one of said inside reference potentials; and a second voltage buffer circuit connected at a tap of said second resistor, for providing the other of said inside reference potentials;

a data driver for applying one of said outside and inside reference potentials, a divided potential between said one of said outside reference potentials and one of said inside reference potentials, or a divided potential between the other of said inside reference potentials and said the other of said outside reference potentials onto each of said data electrodes in compliance with display data; and a scanning driver for cyclically providing scanning pulses to said scanning electrodes.

21. A method for driving a liquid crystal display apparatus, comprising the steps of:

generating a pair of outside reference potentials and a pair of inside reference potentials each of which is between said outside reference potentials;

providing a combined resistor including a variable first resistor connected in parallel with a second resistor for generating one of said outside reference potentials and said inside reference potentials; and automatically correcting a deviation of a center potential of said outside or inside reference potentials by changing a resistance value of said variable first resistor provided in said corresponding outside or inside reference potentials.

* * * * *